US008414030B2

(12) United States Patent
Hirano et al.

(10) Patent No.: US 8,414,030 B2
(45) Date of Patent: Apr. 9, 2013

(54) SKATE GUARD AND WALKING DEVICE

(75) Inventors: Motoaki Hirano, Markham (CA); Takuya Hirano, Markham (CA)

(73) Assignee: Questa Design Ltd., Scarborough, ON (CA)

( * ) Notice: Subject to any disclaimer, the term of this patent is extended or adjusted under 35 U.S.C. 154(b) by 735 days.

(21) Appl. No.: 12/588,082

(22) Filed: Oct. 2, 2009

(65) Prior Publication Data

US 2011/0079995 A1 Apr. 7, 2011

(51) Int. Cl.
*A63C 3/12* (2006.01)

(52) U.S. Cl.
USPC ..... 280/825; 280/811

(58) Field of Classification Search ..... 280/11.12, 280/11.16, 11.18, 809, 811, 825
See application file for complete search history.

(56) References Cited

U.S. PATENT DOCUMENTS

| | | | | | |
|---|---|---|---|---|---|
| 1,554,434 | A | | 9/1925 | Johnson | |
| 1,686,667 | A | | 10/1928 | Kaskey | |
| 1,788,433 | A | * | 1/1931 | Johnson | 280/825 |
| 2,108,128 | A | * | 2/1938 | Kinney | 280/11.18 |
| 2,205,412 | A | * | 6/1940 | Jahnke | 280/825 |
| 2,213,966 | A | * | 9/1940 | Nygaard | 280/11.18 |
| 3,135,526 | A | * | 6/1964 | Johns | 280/825 |
| 3,583,720 | A | | 6/1971 | Fowlkes | |
| 3,908,224 | A | * | 9/1975 | Vitt | 16/332 |
| 4,252,345 | A | | 2/1981 | Cabral | |
| 4,365,828 | A | | 12/1982 | Hall et al. | |
| 4,382,615 | A | * | 5/1983 | Gronborg et al. | 280/825 |
| 4,382,616 | A | | 5/1983 | Olivieri | |
| 4,392,674 | A | | 7/1983 | Evon | |
| 5,183,292 | A | | 2/1993 | Ragin | |
| 5,290,065 | A | | 3/1994 | Kassal | |
| 5,513,881 | A | | 5/1996 | DiMeglio et al. | |
| 5,580,094 | A | | 12/1996 | Ruehlman et al. | |
| 5,941,568 | A | | 8/1999 | White, II | |

FOREIGN PATENT DOCUMENTS

| | | |
|---|---|---|
| CA | 2169774 | 8/1997 |

* cited by examiner

*Primary Examiner* — J. Allen Shriver, II
*Assistant Examiner* — Bryan Evans
(74) *Attorney, Agent, or Firm* — Lynn C. Schumacher; Stephen W. Leonard; Hill & Schumacher

(57) ABSTRACT

The present invention provides a skate guard having an elongated body piece with a longitudinal channel for receiving a skate blade, and an end piece adapted to pivot relative to the body piece. The end piece, which is adapted to receive an end portion of a skate blade, may be pivotally and detachably secured in a closed position whereby a skate blade is held within the guard. In a preferred embodiment, a biased latch member is provided in the end piece to further secure a blade within the guard and to enable a user to install the guard by a step-in process. The end piece is preferably connected to the body piece though an adapter piece that enables the guard to be configured for a variety of skate lengths and shapes. The skate guard preferably includes lateral stabilizing ball and heel segments for added stability when walking and installing the guard.

29 Claims, 17 Drawing Sheets

SKATE GUARD AND WALKING DEVICE

FIELD OF THE INVENTION

This invention relates to devices for the protection of ice skate blades. More particularly, the invention relates to an improved skate protection device with ease of attachment and removal of the device to a skate blade, and ease of walking with the device attached to a skate blade.

BACKGROUND OF THE INVENTION

Devices for the protection of ice skate blades have been known in the art for decades. Early skate guard devices, such as those provided in U.S. Pat. Nos. 1,686,667 and 3,583,720, employ a simple design involving a single, elongated body, with an upwardly open channel for receiving and housing the blade (or runner) of an ice skate, and a strap such as a metal spring adapted to secure the body to the rear portion of an ice skate blade. Such designs suffer from a number of drawbacks, including the requirement for a significant degree of manual dexterity and the requirement for a large applied force when affixing the guard to a blade and a lack of stability when walking with the guard in place. More importantly, these devices pose a high risk of personal injury to the user while applying the necessary force to secure the guard in place, which could result in laceration of the user's hand across the sharp skate blade.

Recent designs have attempted to improve over the problems associated with the earlier designs by providing a two-piece design, in which front and rear pieces are connected together by an elastic member. An example of such a design in provided in U.S. Pat. No. 5,513,881, in which front and rear pieces, each having an upwardly open channel for receiving an ice skate runner, are connected together by an elastic center piece. Unfortunately, such devices fail to overcome the main problems associated with the initial designs. In particular, the use of an elastic member to secure the guard to the skate causes the user to have to apply significant force to separate the two pieces, while at the same time attempting to accurately place the runner edge into the narrow channel in both the front and rear portions. This complex requirement leads to difficulty in securing the guard to the skate, with the aforementioned problems associated with difficulty and potential hazard.

U.S. Pat. No. 5,941,568 provides an alternative two-piece design in which a rear support block is slidably received in a channel located in an elongated body piece. The rear support piece contains a recess for receiving the rear portion of a runner, and a spring connecting the rear support block to the body piece is employed to bias the support block against the rear portion of the runner. This variation on the aforementioned two-piece design suffers from the many drawbacks noted above, namely the installation and removal is a hand-held operation requiring the user to pull back on the rear support block and apply a significant force while attempting to place the runner within the toe section and channel. Additionally, the recessing of the spring below the blade receiving channel in this design produces a high-profile guard that has poor stability when walking. Furthermore, the rear support piece has a fixed profile, and is not adapted for use with different skate and blade types.

Another variation on the two piece guard design is provided in U.S. Pat. No. 4,382,615, which discloses a guard comprising two telescoping pieces. The first and second telescoping pieces, which are locked together when in use, each include an upwardly open channel for receiving the runner, and the rear piece is adapted to receive the heel portion of a runner. The front piece further includes an s-shaped leaf spring for securing the runner in the guard, and, notably, to clamp the runner within the guard during use. To install the guard on a skate, a user may place the guard on the ground, insert the heel portion of the runner into the rear piece, and press downward on the leaf spring with the toe portion until the toe portion bypasses the spring and is clamped in place. This design, while improving on prior art skate guards, disadvantageously requires the user to apply a significant force to separate the runner from the guard due to the clamping force of the leaf spring. Furthermore, the pre-determined geometrical profile of the leaf spring results in a guard that will only be compatible with a limited number of skate types. An additional disadvantage is the lack of support with regard to lateral tilting when installing the guard. Finally, the lack of a guiding means for the insertion of the top portion presents a challenge to the user to quickly and accurately step into the guard.

As noted above, most prior art designs of skate guards also provide poor support to the user when walking with the guard attached to the runner. While some US patents have disclosed guards with rounded toe and heel sections, typical guard designs are extremely thin and suffer from very poor lateral stability when walking. An attempt to provide an improvement in this regard is provided in Canadian Patent No. 2,169,774, which teaches a simple guard that essentially comprises a block with an internal channel for housing the blade, with straps for attaching the block to the skate. This design has numerous drawbacks, and is very heavy and cumbersome, which can actually lead to increased difficulty when walking.

Therefore, it is readily apparent that skate guards disclosed in the prior art are chiefly designed with the goal of protecting the blade rather than protecting the user. Despite the improvements cited above, the prior art fails to provide a skate guard that is easily installed onto, and removed from, a skate. In particular, all prior art designs involve the application of a significant force between the runner and the guard that must be overcome when installing and removing the guard, with little or no lateral support when walking. This leads to difficulty and a risk of personal injury, especially for children. What is therefore needed is a design that enables a skate guard to be easily installed and removed by the user and provides support to the user when walking.

SUMMARY OF THE INVENTION

The present invention overcomes the aforementioned deficiencies with the prior art by providing a skate guard adapted to enable the rapid, safe, and stable installation and removal of a blade. More specifically, embodiments of the invention provide a skate guard incorporating a pivoting member adapted to secure a skate blade without requiring a user to apply a longitudinal force to the guard, thereby significantly improving the ease at which the guard can be installed, and dramatically lowering the potential risk of injury. Specifically, the lower risk of injury arises from the improved design in which the user's hand is not exposed to, or forced relative to, the blade when installing or removing the skate guard. The skate guard comprises an elongated body piece having a longitudinal channel to receive a first end of a skate blade, and an end piece adapted to receive a second end of a skate blade. The end piece may be pivoted relative to the body piece, and a means is included for detachably securing the end piece in a closed position whereby a skate blade is held within the guard. The pivoting end piece is preferably connected to the body piece though an adapter piece that enables the guard to be configured for a variety of skate lengths and shapes. Moreover, the guard can be further configured for use with a wide variety of skate styles and lengths by removing the adapter piece, cutting a portion of the body piece, and re-installing the adapter piece.

Accordingly, in one aspect of the invention, there is provided a skate guard comprising:

a) a body piece comprising a longitudinal channel adapted to receive a skate blade partially therein, the body piece further comprising a socket for receiving a first end of the blade at a first end of the body piece;

b) an adapter piece configured to be detachably secured to the body piece at one or more positions along a direction substantially parallel to a longitudinal axis of the body piece, wherein an end of the adapter piece projects beyond a second end of the body piece;

c) an end piece pivotally attached to the end of the adapter piece, the end piece adapted to secure a second end of the blade when the end piece is upwardly pivoted into a closed position; and d) means for detachably securing the end piece in the closed position.

The skate guard preferably further includes a biased latch member that is provided in the end piece to further secure a blade within the guard and to enable a user to install the guard by a step-in process. Accordingly, in another aspect of the invention, the skate guard further comprises a latch member movable relative to the end piece, and a latch member biasing means, wherein the latch member biasing means is adapted to contact a portion of the latch member with the second end of the blade when the end piece is in the closed position.

In yet another aspect invention, a skate guard is provided with stabilizing segments for improved lateral stability. Lateral stabilizing segments are preferably provided at the heel and/or ball section of the skate guard. Accordingly, in another embodiment, the invention provides a skate guard comprising heel segments extending laterally from a rear portion of the skate guard, the heel segments adapted to contact a floor or other surface when a user is walking with the skate guard installed. In another embodiment, the invention provides a skate guard comprising ball segments extending laterally from a front portion of the skate guard, the ball segments adapted to contact a floor or other surface when a user is walking with the skate guard installed. In a preferred embodiment of the invention, the skate guard comprises both ball and heel segments.

In yet another aspect of the invention, there is provided a skate guard comprising a lower surface having a recess therein, the recess extending over a width of the skate guard, wherein the recess forms a separation between a first floor contacting segment and a second floor contacting segment.

A further understanding of the functional and advantageous aspects of the invention can be realized by reference to the following detailed description and drawings.

BRIEF DESCRIPTION OF THE DRAWINGS

The embodiments of the present invention are described with reference to the attached figures, wherein.

DETAILED DESCRIPTION OF THE INVENTION

Generally speaking, the embodiments described herein are directed to a skate guard for use in protecting a skate blade and for protecting a user during installation and use. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to a skate guard for use in protecting a skate blade and for protecting a user during installation and use.

As used herein, the terms, "comprises" and "comprising" are to be construed as being inclusive and open ended, and not exclusive. Specifically, when used in this specification including claims, the terms, "comprises" and "comprising" and variations thereof mean the specified features, steps or components are included. These terms are not to be interpreted to exclude the presence of other features, steps or components.

As used herein, the terms "about" and "approximately, when used in conjunction with ranges of dimensions of particles, compositions of mixtures or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

As used herein, the coordinating conjunction "and/or" is meant to be a selection between a logical disjunction and a logical conjunction of the adjacent words, phrases, or clauses. Specifically, the phrase "X and/or Y" is meant to be interpreted as "one or both of X and Y" wherein X and Y are any word, phrase, or clause.

Figure 1:
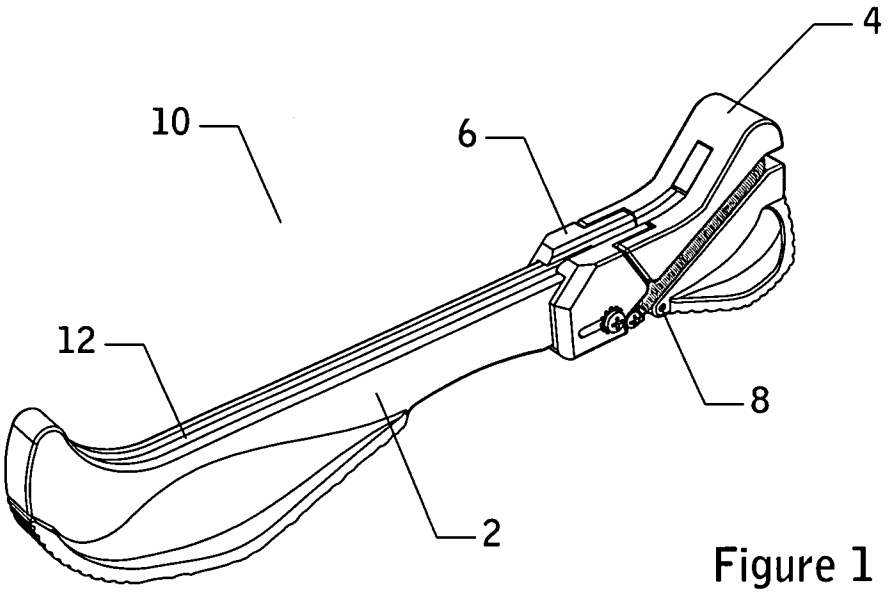
FIG. 1 is a perspective view of the improved skate guard.

With reference to FIG. 1, it can be seen that a skate guard 10 according to an embodiment of the invention is formed of an elongated body piece 2 and an end piece 4 that is adapted to pivot relative to the longitudinal axis defined by the body piece. The skate guard further includes an adapter piece 6 for connecting the end piece to the body piece, and for providing a means to vary the location of the end piece and relative to the body piece 2 to accommodate skates of different length. End piece 4 pivots relative to adapter piece 6 via hinge pin 8.

Figure 2:
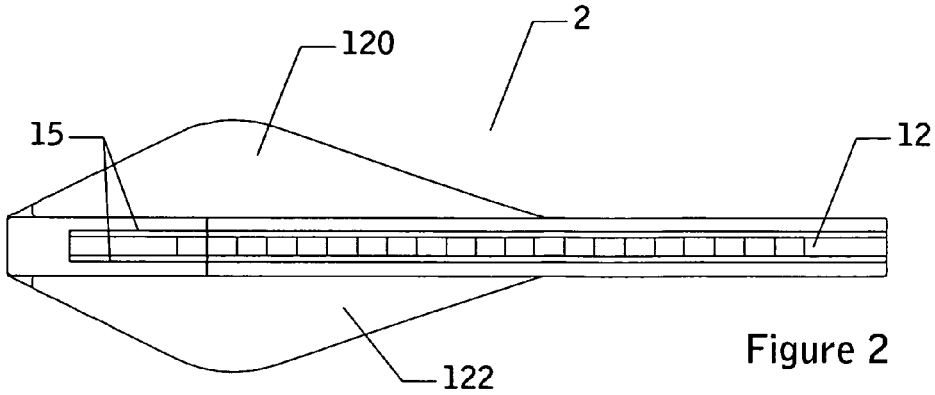
FIG. 2 is a plan view of the body piece.
Figure 3:
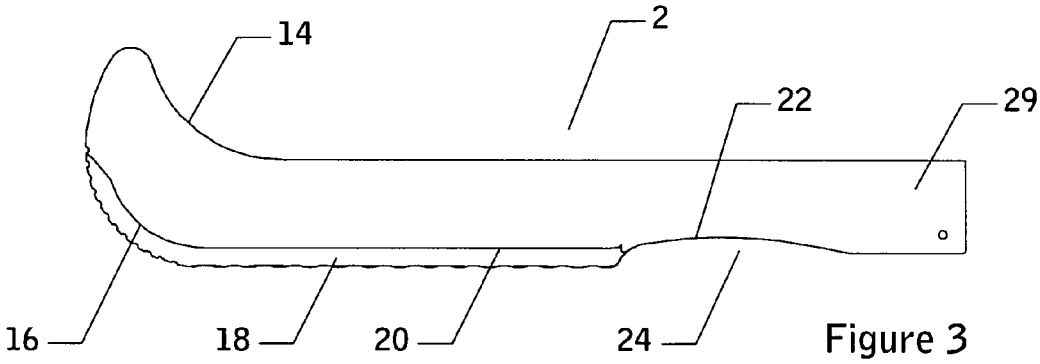
FIG. 3 is a side view of the body piece.
Figure 4:
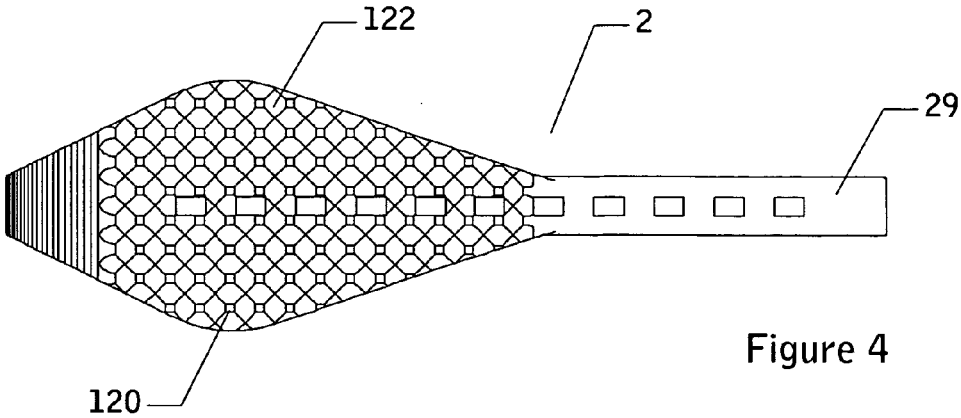
FIG. 4 is a bottom view of the body piece.
Figure 6:
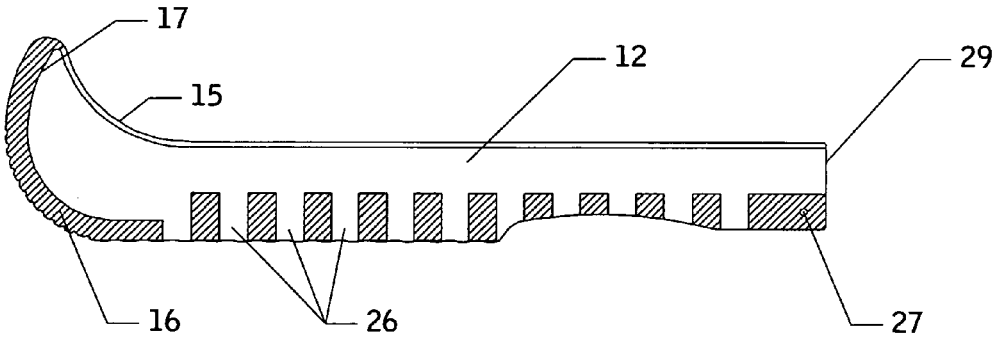
FIG. 6 is a transverse section view of the body piece as seen along the line I-I in FIG. 5.

Referring to FIGS. 2-4, body piece 2 is adapted to include a socket for receiving an end of an ice skate. Preferably, body piece 2 includes an upwardly oriented channel 12 for receiving the blade of an ice skate. Preferably, channel 12 has a width approximately equal to or slightly larger than that of a standard skate blade. Channel 12 preferably terminates at the toe end 14 of the body piece in the form of an upwardly sloping surface 16 that is best shown in FIG. 6. Surface 16 is adapted to receive and secure the toe end of an ice skate, whereby the upward section 17 of surface 16 confines the toe portion of a blade vertically when the blade is secured in the skate guard. Accordingly, channel edges 15 within upward section 17 secure the skate against tilt when installed.

Figure 5:
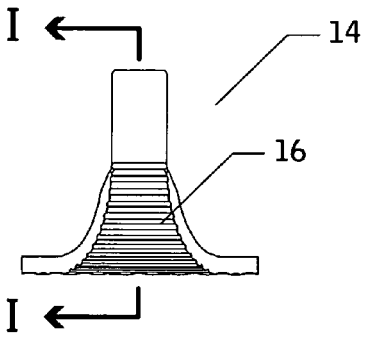
FIG. 5 is a front view of the body piece.

As best shown in FIG. 6 (which is a section along the plane shown in FIG. 5), a plurality of through holes 26 are preferably incorporated into body piece 2 along the bottom surface of channel 12, to provide a drainage path for melting ice and other debris that may be present on the skate blade when the blade is secured in the guard.

Adapter piece 6, shown in FIGS. 7-10, includes a recess 30 for receiving an end portion 29 of body member 2 and a longitudinal channel 32 for receiving an intermediate portion of a skate blade. Channel 32 preferably has a width and depth approximately equal to that of channel 12, but those skilled in the art will readily appreciate that channel 32 may be deeper and/or wider that channel 12.

Figure 7:
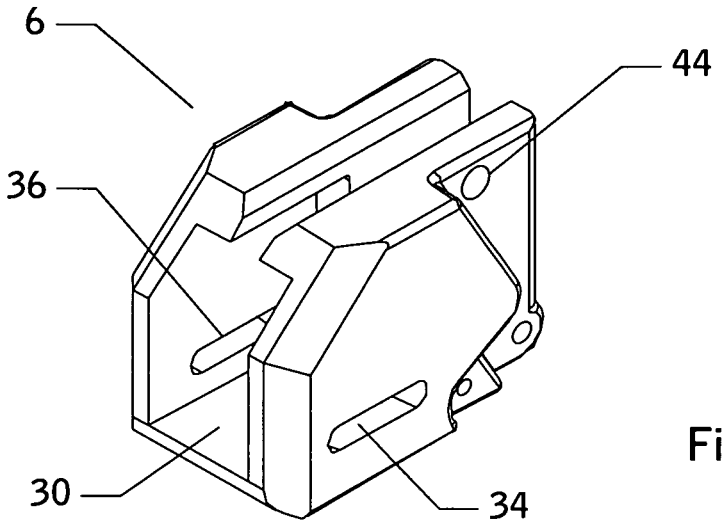
FIG. 7 is a first perspective view of the adapter piece.
Figure 8:
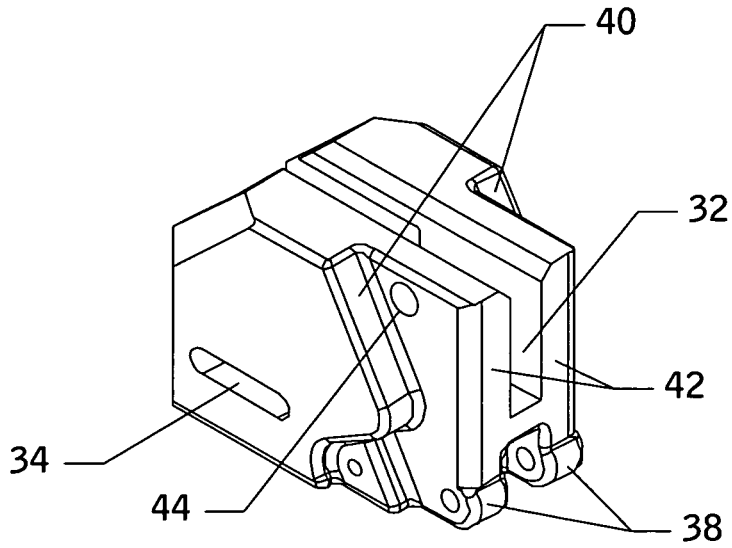
FIG. 8 is a second perspective view of the adapter piece.
Figure 9:
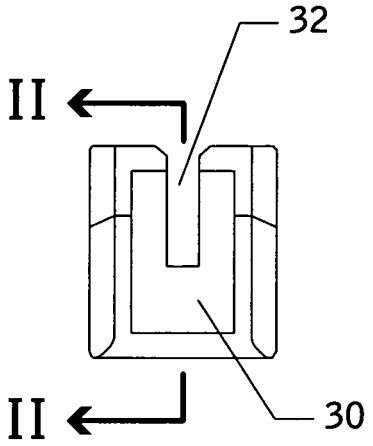
FIG. 9 is a front view of the adapter piece.
Figure 10:
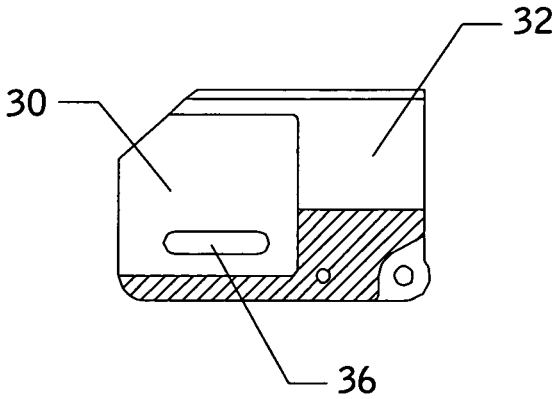
FIG. 10 is a transverse section view of the adapter piece, as seen along the line II-II in FIG. 9.
Figure 23:
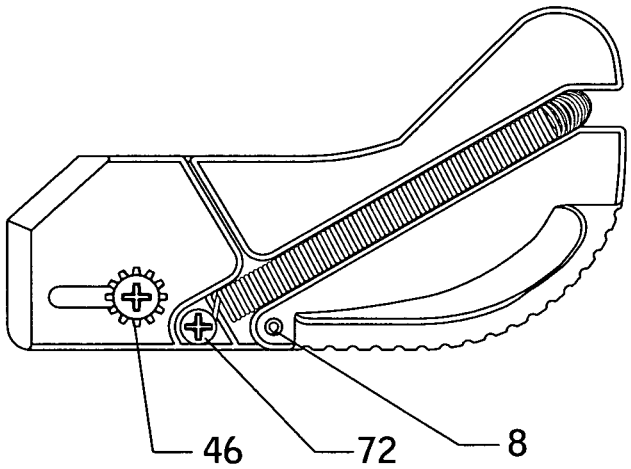
FIG. 23 is a side view of the end piece pivotally connected to the adapter piece.
Figure 24:
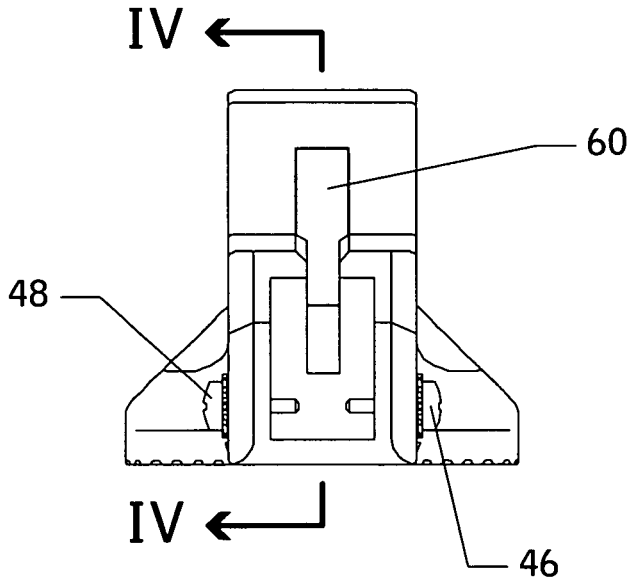
FIG. 24 is a front view of the end piece pivotally connected to adapter piece.

Recess 30 permits slidable engagement of end portion 29 of body piece 2. As described below, the skate guard is configured for a given skate length by selecting an appropriate position of adapter piece 6 relative to body piece 2. Adapter piece 6 is configured to be detachably secured to body piece 2. As shown in FIG. 7, adapter piece 6 includes lateral slots 34, 36 for inserting fasteners 46 and 48 (shown in FIGS. 23 and 24). Preferably, fasteners 46 and 48 are self-tapping screws, which after assembly, produce holes in body piece 2 (for example, hole 27). While the preferred embodiment the means of securing adapter piece involves lateral slots 34 and 36 and self-tapping screws 46 and 48, those skilled in the art will appreciate that there are many alternative schemes for attaching adapter piece 6 to body piece 2. For example, body piece 2 may include one or more threaded holes for receiving fasteners 46 and 48 are various longitudinal locations. Adapter 6 further includes hinge member 38, contact surfaces 40, and contact surfaces 42.

Figure 19:
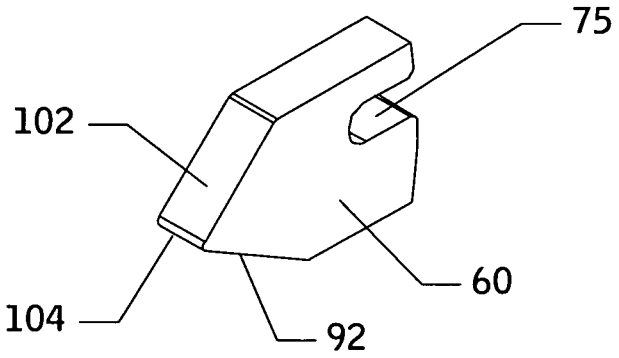
FIG. 19 is a perspective view of the latch member.

Referring to FIGS. 11-17, end piece 4 includes a lower channel 50 (shown in FIG. 17) for receiving the rear portion of a skate blade, and an upper recess 52 for receiving latch member 60 (shown in FIG. 19). End piece further includes hinge member 54, contact surfaces 56, and contact surfaces 58.

As shown in FIGS. 21-24, end piece 4 is pivotally attached to adapter piece 6 though a hinge formed from hinge members 38 and 54, and hinge pin 8. Other means of pivotally mounting the end piece to the adapter piece may be employed, such as individual pivot bolts provided on opposite sides of the guard. Alternatively, end piece 4 may pivot relative to adapter piece 6 through a living hinge, and end piece 4 and adapter piece 6 may be formed as single component with a living hinge provided therebetween.

Figure 22:
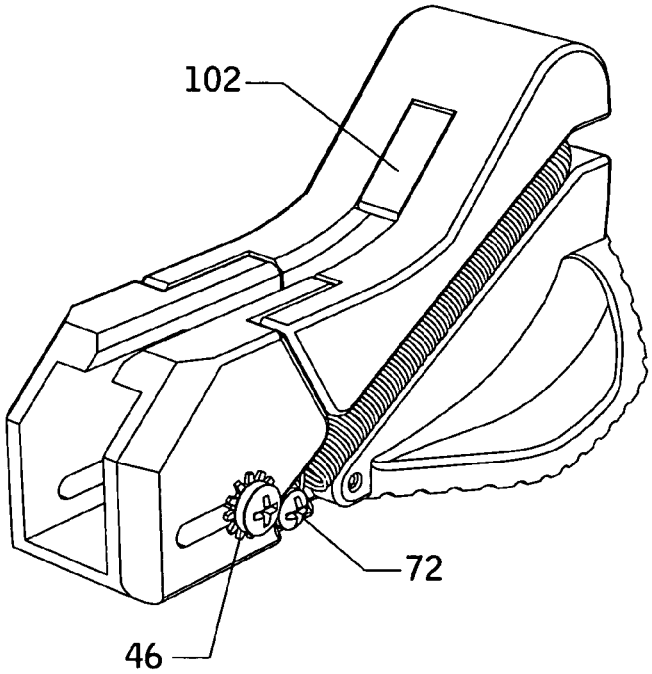
FIG. 22 is a perspective view of the end piece pivoted into an open position with respect to the adapter piece.
Figure 21:
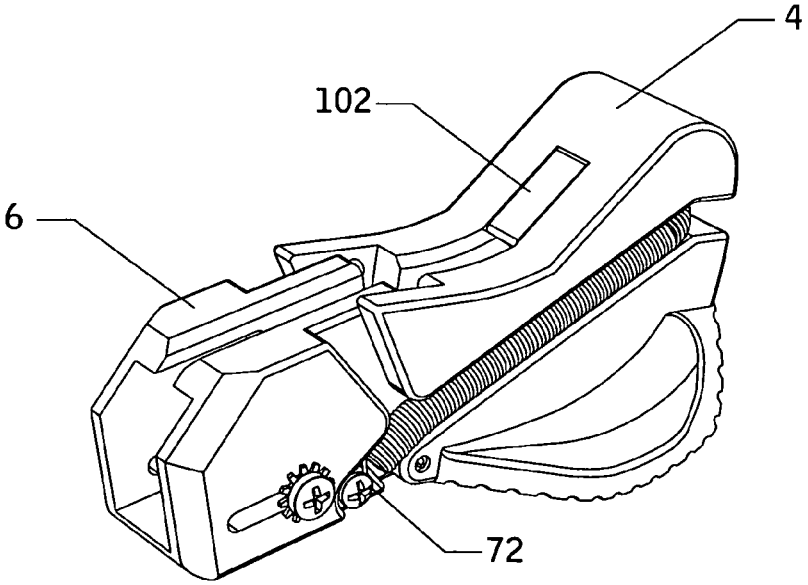
FIG. 21 is a perspective view of the end piece pivoted into the closed position with respect to the adapter piece.

End piece 4 may be pivoted from an open position shown in FIG. 21, to a closed position shown in FIG. 22. As can be appreciated from FIG. 22, further upward rotation of end piece 4 beyond the closed position is prevented by the mating of contact surfaces 40 and 56, and contact surfaces 42 and 58. Those skilled in the art will readily appreciate that various means of arresting the further motion of end piece 4 in the closed position are possible, such as the use of individual contact points rather than contact surfaces, or a combination thereof. In another embodiment, the further rotation of end piece 2 beyond the closed position may be prevented by a contact between the bottom surface of a skate blade and low surface 64 of lower channel 50.

End piece 4 is preferably secured in the closed position by a detachable means such as an elastic member configured to bias the rotation of end piece 4 toward the closed position shown in FIG. 22. As will be apparent to those skilled in the art, end piece 4 may be biased towards the closed position by a variety of elastic biasing means and configurations. In a preferred embodiment shown in FIGS. 21-25, end piece 4 is biased toward the closed position by spring 70, with the ends of spring 70 secured to opposite sides of adapter piece 6 by fasteners 72 and 74 (not shown). Spring 70 passes behind end piece 4, and is secured between fasteners 72 and 74 under tension when end piece 4 is positioned in the closed position. As end piece 4 is rotated in a downward fashion away from the closed position, the length of spring 70 is increased, thereby increasing the rotationally biasing force applied to end piece 4.

End piece 4 contains lateral guide channels 76 (best shown in FIGS. 12 and 14) and 78 (not shown) and rear channel 80 housing spring 70 on end piece 4. While spring 70 is shown oriented in an upward and outward direction, spring 70 (or more generally, an elastic member) may be positioned in a variety of configurations that produce the desired outcome of rotationally biasing end piece 4 toward the closed position.

Figure 11:
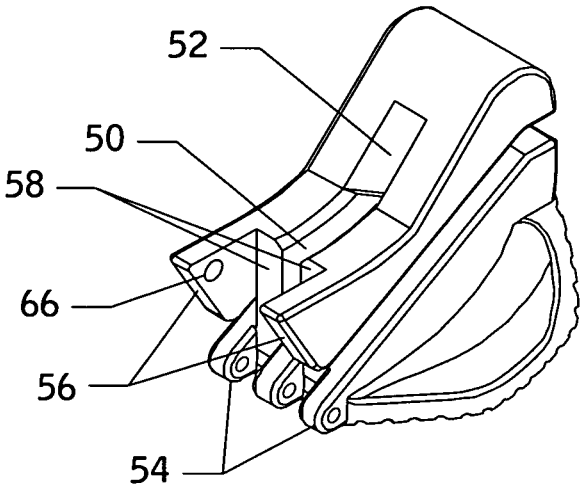
FIG. 11 is a first perspective view of the end piece.
Figure 12:
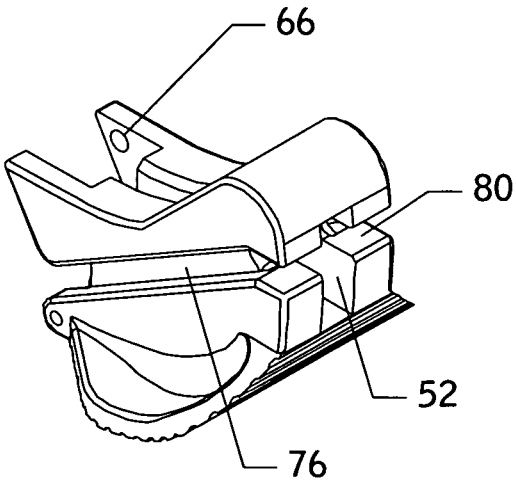
FIG. 12 is a second perspective view of the end piece.
Figure 13:
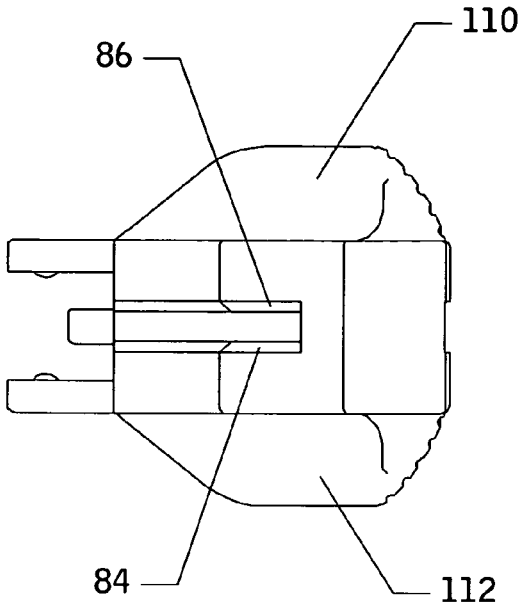
FIG. 13 is a plan view of the end piece.
Figure 14:
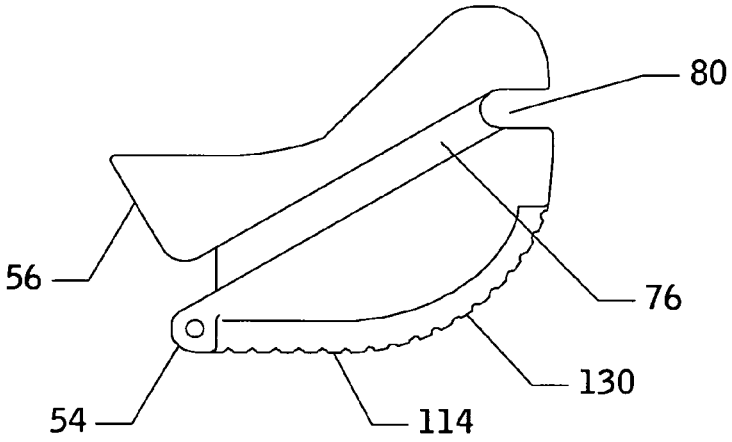
FIG. 14 is a side view of the end piece.
Figure 15:
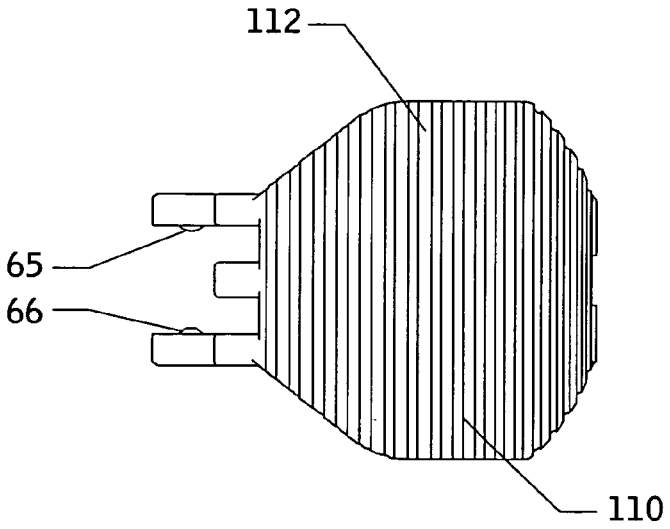
FIG. 15 is a bottom view of the end piece.
Figure 16:
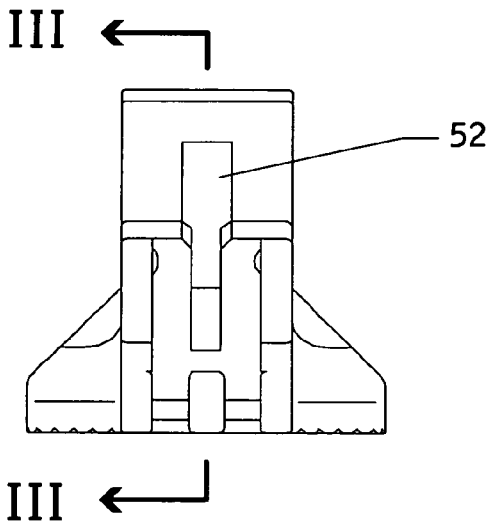
FIG. 16 is a front view of the end piece.
Figure 17:
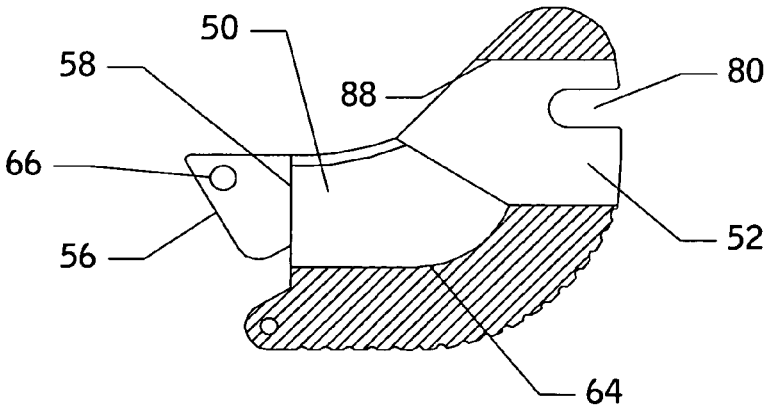
FIG. 17 is a transverse section view of the end piece, as seen along line III-Ill in FIG. 16.
Figure 18:
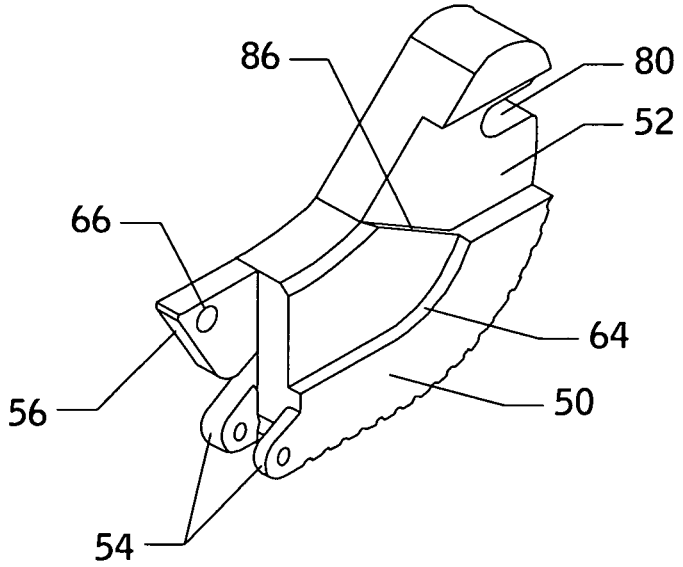
FIG. 18 is a transverse section perspective view of the end piece, as seen along line III-III in FIG. 16.

Additionally or alternatively, end piece 4 may be detachably secured to adapter piece via other means including, but not limited to, frictional engagement, magnetic engagement or a ball detent. FIGS. 7 and 11 show exemplary locations for securing a first ball detent member with a second ball detent member in adapter piece 6 and end piece 4, respectively. Preferably, a ball detent is recess provided on each lateral side of adapter piece 6 (one recess is shown at 44 in FIG. 8) and corresponding ball detents are provided in end piece 4 (shown at 65 and 66 in FIG. 15). The inclusion of such a secondary mechanism for detachably securing the end piece in the closed position provides improved adherence of the skate guard when installed on a blade.

Figure 25:
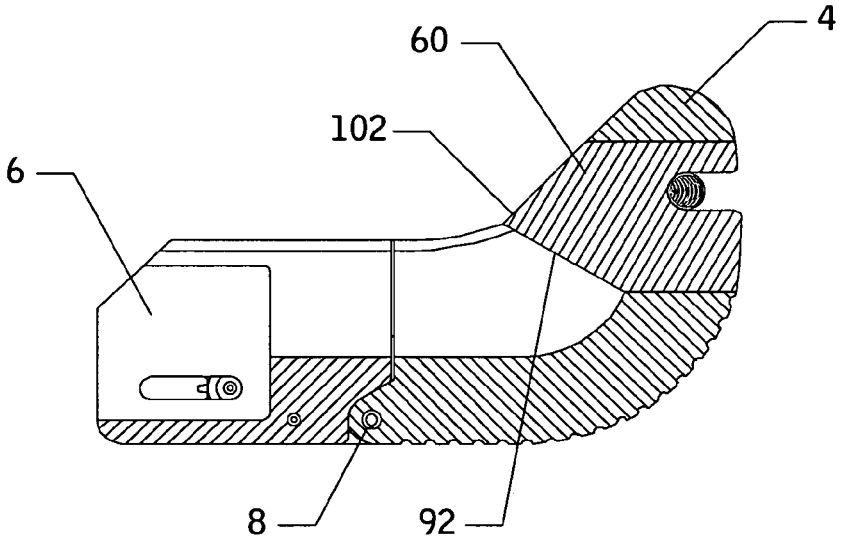
FIG. 25 is a transverse section of the end piece pivotally connected to adapter piece, as seen along line IV-IV in FIG. 24.
Figure 26:
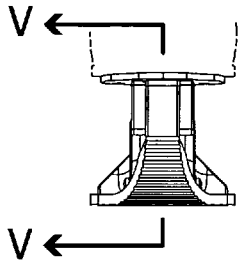
FIG. 26 is a front view of a skate blade (shown in broken lines) secured in a skate guard according to one embodiment of the invention.

As shown in FIGS. 21, 22 and 25, latch member 60 is slidably received in upper recess 52. Latch member is biased towards the opening of upper recess 52 by a biasing means that is preferably an elastic means such as a spring. The biasing means may incorporate an internal stop, or the biasing means may bias latch member 60 towards a stop such as stop surfaces 84 and 86 (best seen in FIG. 13), whereby latch member 60 is retained by stop surfaces 84 and 86 and upper surface 88 (visible in FIG. 17).

Figure 20:
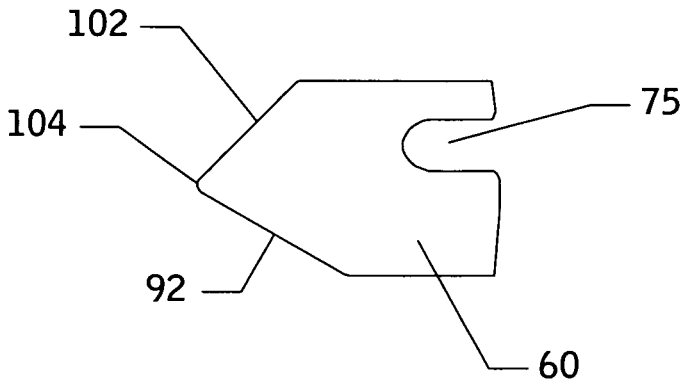
FIG. 20 is a side view of the latch member.

In a preferred embodiment, the latch member 60 is biased by an elastic biasing means employed to rotationally bias end piece 4 towards the closed position. This preferred embodiment is shown in FIGS. 21, 22 and 25, where latch member 60 is shown biased towards the opening of upper recess 52 by spring 70, which is received in notch 75 provided in latch member 60 (as shown in FIGS. 19 and 20).

Figure 27:
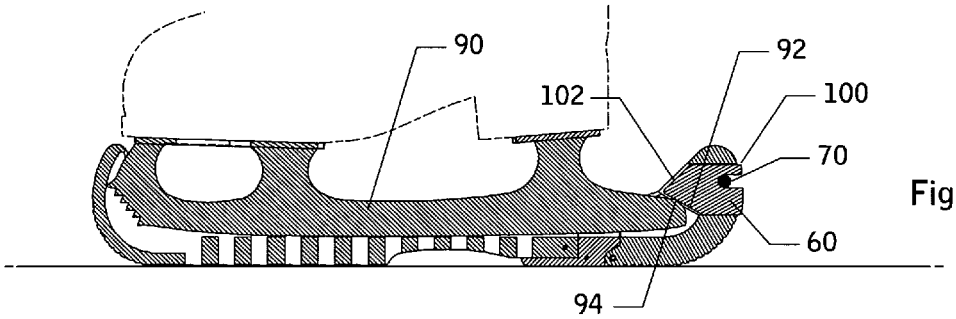
FIG. 27 is a transverse section showing a skate secured in the skate guard by the latch member, as seen along line V-V in FIG. 26.

The role of latch member 60 in securing a blade within the skate guard is best illustrated in reference to FIG. 27, which shows a skate blade 90 secured within a skate guard according to a preferred embodiment of the invention. Latch member 60 includes outwardly projecting surface 92 (also shown in FIGS. 19 and 20) that is adapted to contact at least an upper rear portion 94 of blade 90 when biased by a biasing means (for example, spring 70 as described above).

Surface 92, having a perpendicular direction pointing towards the front of the skate guard beneath a longitudinal axis of body piece 2, applies a force to skate blade 90 in a forward and downward direction due to the orientation of surface 92. Those skilled in the art will appreciate that while the exemplary embodiment shown in FIG. 27 involves a planar surface, alternative embodiments within the scope of the invention include variations such as, but not limited to, a curved surface, and a surface having one or more projected contact points.

Advantageously, this preferred embodiment in which latch member 60 includes outwardly projecting surface 92 involves the application of a retaining force to the skate blade that is not linear, but is instead a sliding tangential force provided by the contact of projecting surface 92 with upper rear portion 94 of blade 90. Accordingly, a relatively small force is required break the holding force when removing skate blade 90 from the blade guard, as this embodiment involves the principle of the pivot and lever. The lever (which is a force multiplier) applies the necessary force to break the connection force between the projecting surface against the blade by rotating about the hinge pin 8, and simultaneously the latch member is slid off of the upper rear portion 94, thereby releasing blade 90. In contrast to prior art designs, the user is not required to exert a large longitudinal force to insert and/or release the blade. Furthermore, although the embodiments described about utilize a latch member biasing means such as a spring, blade 90 is secured to the skate guard primarily by the geometry of the latch member and the self securing nature of pivoting end piece 4.

The amount of force applied by biased latch member 60 to the end of blade 90 may be adjusted by varying the relative position of adapter piece 6 relative to body piece 2. As shown in FIG. 27, in a preferred embodiment, latch member is displaced by a distance 100 corresponding to a small fraction of its overall length by the contact of projecting surface 92 with upper rear portion 94 of skate blade 90. In a preferred embodiment, this distance is approximately $1/16^{th}$ of an inch. A user may select such a configuration by choosing an appropriate location to secure adapter piece 6 relative to body piece 2, whereby latch member 60 is displaced by a desired distance when blade 90 is secured and end piece 4 is in the closed position.

In a preferred embodiment, latch member 60 is further adapted to enable a user wearing a skate to step into the skate guard. Latch member 60 preferably further includes a second outwardly projecting surface 102 located above aforementioned outwardly projecting surface 92, with surfaces 92 and 102 meeting at a distal end 104 of latch member 60 (shown in FIGS. 19 and 20). Accordingly, surface 102 has a perpendicular direction pointing towards the front of the skate guard above a longitudinal axis of body piece 2.

Figure 28:
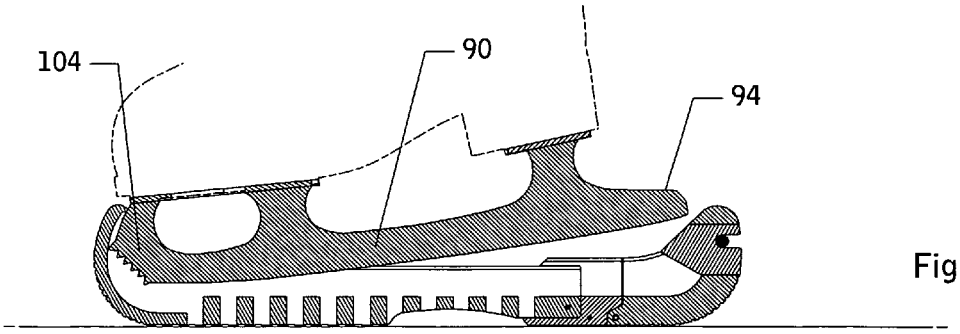
FIG. 28 is a transverse section illustrating the process of securing a blade in the skate guard, showing the toe end of the blade received in the body piece of the skate guard, as seen along line V-V in FIG. 26.
Figure 29:
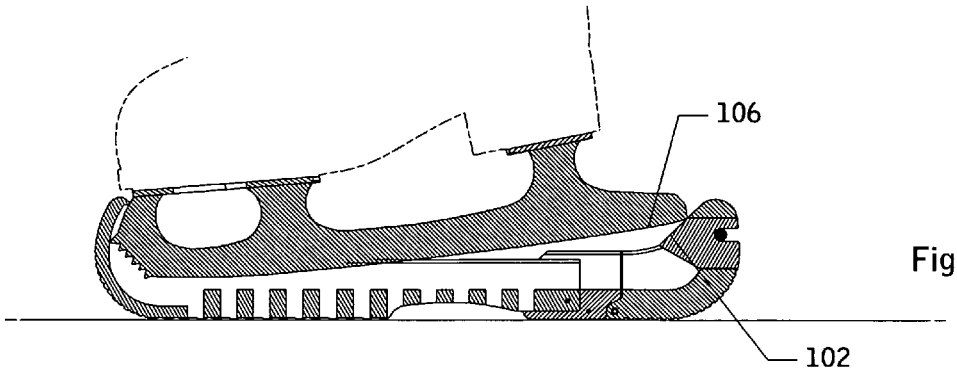
FIG. 29 is a transverse section illustrating the process of securing a blade in the skate guard, showing the rear section of the blade making contact with the upper outwardly projecting surface of the latch member, as seen along line V-V in FIG. 26.
Figure 30:
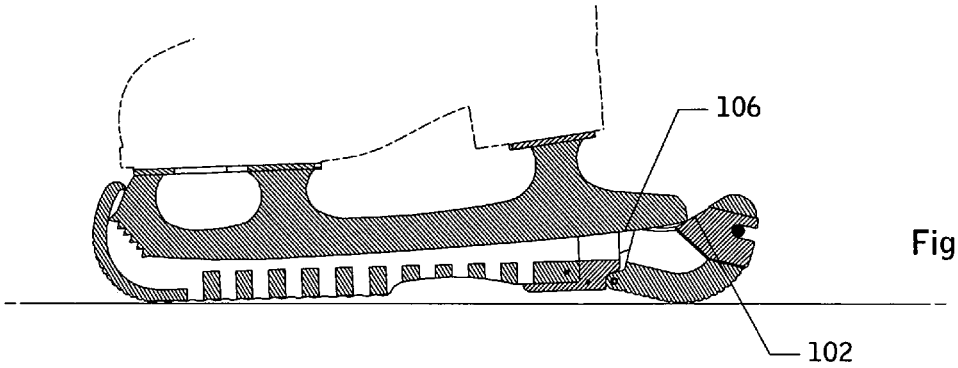
FIG. 30 is a transverse section illustrating the process of securing a blade in the skate guard, showing the end piece pivoted downward, as seen along line V-V in FIG. 26.

FIGS. 28-31 illustrate the process of engaging a skate blade in a skate guard according to this embodiment of the invention by stepping into the guard. As shown in FIG. 28, blade 90 is initially positioned with the skate guard by a user wearing a skate so that toe end 104 of blade 90 is received in toe end 14 of body piece 2. As illustrated in FIG. 29, the user then pivots blade 90 in a rearward direction to contact the lower surface 106 of the rear portion of blade 90 with outwardly projecting surface 102 of latch member 60. As further force is applied by the user rotating the heel section of the skate backward (shown in FIG. 30), end piece 2 may rotate with respect to adapter piece 6 during this process.

Figure 31:
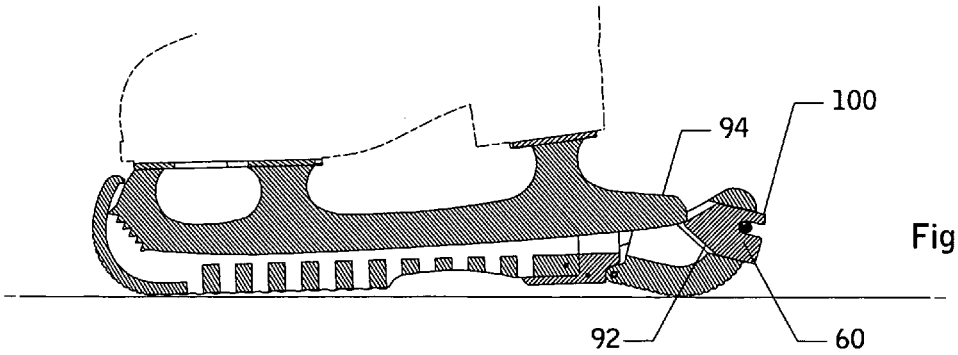
FIG. 31 is a transverse section illustrating the process of securing a blade in the skate guard, the latch member forced in a rearward direction and the lower outwardly projecting surface of the latch member making contact with the upper rear portion of the blade, as seen along line V-V in FIG. 26.

As shown in FIG. 31, after additional downward pivoting of blade 90, outwardly projecting surface 92 contacts upper rear portion 94 of blade 90. At this point, latch member 60 is forced rearward by the force of blade applied to the latch member biasing means (spring 70 in the specific embodiment shown). The rearward travel of latch member 60 is shown in FIG. 31 by displacement distance 100. Subsequently, blade 90 is further rotated until it is fully received in the skate guard, as shown in FIG. 27. During this final step, a securing force is applied to blade 90 by the contact of outwardly projecting surface 92 with upper rear portion 94 of blade 90, under a force applied by the latch member biasing means. Accordingly, this preferred embodiment provides an improved skate guard design that results in enhanced simplicity, safety, and speed when both installing and removing the skate guard from a skate blade.

The skate guard may be manufactured using a wide variety of engineered plastics, such as acetal homopolymer, acetal copolymer, nylon, polypropylene, polycarbonate, polyethylene, ABS, and PVC. The preferred material is high density polyethylene or polypropylene. Furthermore, if the tread is over-moulded, this moulded tread can possibly be a different material than the guard, the preferred material being polyethylene or polypropylene.

Preferably, a compliant and slip-resistant material is additionally applied to the lower surface of the body member to improve traction when walking. The slip-resistant material may include, but is not limited to, sandpaper, rubber coatings, and paint incorporating a grit material. Preferably, the slip-resistant material is an over-molded rubber coating, which may, for example, be attached to the bottom surface of the guard with an adhesive material or through a thermal fusion process The slip-resistant material may be coated across the entire length of the bottom of the body piece 2, adapter piece 6 and end piece 4, or may be applied along select portions of each or all pieces comprising the skate guard. Preferably, the slip-resistant material is incorporated over at least a portion of curved surface 16 and bottom surface 20 of body piece 2, and curved surface 130 and bottom surface 114 of end piece 4.

The skate guard according to the preceding embodiments may be adapted by the user to engage with skate blades of different sizes and styles by a number of methods. To accommodate small variations in length or shape, the longitudinal position of adapter piece 6 relative to body piece 2 may be varied. To support larger variations, the length of body piece 2 may be modified by the user, for example by removing a section of body piece 2 near end portion 29. In one embodiment, as discussed previously, adapter piece 6 is secured to body piece 2 using self-tapping screws that are received in lateral slots 34 and 36. The slots provide a means of making fine adjustments to the relative position of adapter piece 6 and body piece 2. Alternatively, body piece 2 may be adapted to include multiple locations for receiving adapter piece 6, for example, by including multiple threaded holes for receiving a fastener or multiple slots for receiving frictional engagement mating piece on adapter piece 6. Body piece 2 may be further adapted to indicate to a user desired locations for cutting end portion 29, for example with markings or indentations for receiving a saw or knife blade. In another embodiment, the user may remove a first end piece 2, and replace it with a different end piece adapted to accommodate a skate blade having a different style, length or shape.

While the exemplary skate blade 90 shown in FIGS. 27-31 is a figure skate blade, it will be readily apparent to those skilled in the art that the embodiments of the present invention are adaptable to a wide range of skate types, including, but not limited to, figure skates, speed skates, and hockey skates. For example, end piece 4 (and optional latch member 60) may be adapted to house the end portion of a hockey skate blade.

Furthermore, the present invention is not limited to the preceding embodiments including an adapted piece for securing the body piece 2 to end piece 4. In other embodiments, the skate guard may be designed for a specific skate length and/or skate style, and end piece 4 may be pivotally attached to body piece 2 at a fixed location.

Those skilled in the art will appreciate that while illustrative embodiments of the invention provided in the foregoing description have involved embodiments in which the end portion of a skate blade is secured in end piece 4, other embodiments of the invention include securing a toe portion of a skate blade in end piece 4 and an end portion of a skate blade in body piece 2.

In addition to the aforementioned embodiments of the invention, additional embodiments are provided to improve the stability of the user when walking in the guard and also when stepping into the guard. In a preferred embodiment shown in FIGS. 13 and 15, surface 114 of end piece 4 is adapted to provide heel stabilizing segments 110 and 112 that extend laterally from the longitudinal axis defined by body piece 2 when end piece 4 is connected to body piece 2 though adapter piece 6. Heel stabilizing segments 110 and 112 are preferably centered approximately under or behind the corresponding location of the heel of a user's foot, or alternatively, the under or behind the heel section of a skate boot of a skate secured in the guard. Accordingly, when the skate guard is secured to a user's skate, heel stabilizing segments 110 and 112 are located approximately under the heel of the user's foot.

Preferably, the heel stabilizing segments extend laterally from the longitudinal axis defined by body piece 2 so that the distance between the outmost portions of the stabilizing segments is greater than the average width of the skate guard. More preferably, the outermost lateral portion of each heel stabilizing segment 110 and 112 extends at least 1 inch beyond the central axis of body piece 2. Heel stabilizing segments may comprise two distinct lateral surfaces, or may form a continuous planar surface extending beneath end piece 4.

Similarly, in a preferred embodiment shown in FIGS. 2 and 4, surface 20 of body piece 2 is adapted to provide ball stabilizing segments 120 and 122 that extend laterally from the channel 12. Ball stabilizing segments 120 and 122 are preferably centered approximately under or in front of the corresponding location of the ball of a user's foot, or alternatively, the under or in front of the ball section of a skate boot of a skate secured in the guard. Accordingly, when the skate guard is secured to a user's skate, ball stabilizing segments 120 and 122 are located approximately under the ball of the user's foot.

In a preferred embodiment, the ball stabilizing segments are longitudinally tapered in a first direction toward the toe end 14 and second direction toward the end portion 27 of body piece 2. More preferably, the longitudinal taper in the second direction extends to a longitudinal location under a location corresponding approximately to the arch of the user's foot. Preferably, the ball stabilizing segments extend laterally from the longitudinal channel so that the distance between the outmost portions of the stabilizing segments is greater than the average width of the skate guard. More preferably, the outermost lateral portion of each ball stabilizing segment 120 and 122 extends at least 1 inch beyond the central axis of body piece 2. Ball stabilizing segments may comprise two distinct lateral surfaces, or may form a continuous planar surface extending beneath channel 12 of body piece 2.

Stability is also improved by the incorporation of an external curved surface 16 in body piece 2 and curved surface 130 of end piece 4 to enable the forward rotation of the guard when walking, thereby accommodating and supporting natural orientation of the user's foot when walking.

Heel stabilizing segments 110 and 112, and ball stabilizing segments 110 and 112 provide a dramatic increase in stability and control during walking, and especially when "stepping into" the guard as illustrated in FIGS. 27-31. The stabilizing segments provide many advantages: the tipping angle is greatly reduced for the user, more traction surface is provided, and the inclusion of flexible sole provides the user with an automatic roll system to upright itself. Unlike the prior art skate guard designs incorporating broad rectangular platforms or narrow longitudinal members, heel and ball stabilizing segments of the aforementioned embodiments provide maximal support with the minimum amount of guard material.

Furthermore, in the preferred embodiment shown in the figures, ball and the heel segments are spatially separated by recess 24 which forms arch 22. Accordingly, the user's total load force is supported on both the heel and ball segments, thus promoting a better traction contact patch. Arch 22 is preferably included if body member 2 is manufactured from a compliant material, whereby arch 22 provides a mechanism for the absorption of stress and the distribution of stress to the forward and rear sections of the guard while walking. Arch 22 is also useful for allowing a user to step on a lip or other surface projection while walking, in which case the lip or other surface projection may be safely accommodated by the recess 24 under arch 22 without contacting the guard and destabilizing the user.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A skate guard comprising:

a body piece comprising a longitudinal channel adapted to receive a skate blade partially therein, said body piece further comprising a socket for receiving a first end of the skate blade;

an adapter piece configured to be detachably secured to said body piece at one or more positions along a direction substantially parallel to a longitudinal axis of said body piece;

an end piece pivotally attached to said adapter piece, said end piece adapted to secure a second end of the skate blade when said end piece is upwardly pivoted into a closed position while maintaining said adapter piece in a fixed position relative to said body piece;

means for detachably securing said end piece in said closed position; and a latch member movable relative to said end piece, and a latch member biasing means, wherein said latch member biasing means is adapted to contact a portion of said latch member with said second end of said blade when said end piece is in said closed position.

2. The skate guard according to claim 1 wherein said end piece is pivotally attached to said adapter piece with a hinge.

3. The skate guard according to claim 2 wherein said hinge is a living hinge.

4. The skate guard according to claim 1 wherein said means for detachably securing said end piece in said closed position comprises at least one ball detent adapted to detachably secure said end piece to said adapter piece.

5. The skate guard according to claim 1 wherein said means for detachably securing said end piece in said closed position comprises at least one elastic member, each said elastic member positioned to apply a force between said end piece and said adapter piece.

6. The skate guard according to claim 5 wherein said elastic member is a spring.

7. The skate guard according to claim 5 wherein first and second ends of said elastic member are attached at contralateral sides of said adapter piece, and wherein a portion of said elastic member is biased against a rear portion of said end piece.

8. The skate guard according to claim 7 wherein said end piece comprises a channel for guiding and housing said portion of said elastic member.

9. The skate guard according to claim 1 wherein said biasing means is an elastic biasing means.

10. The skate guard according to claim 9 wherein said elastic biasing means is provided by said means for detachably securing said end piece in said closed position.

11. The skate guard according to claim 1 wherein said latch member comprises a first outwardly projecting surface, wherein said first outwardly projecting surface is downward facing when said end piece is in said closed position, and wherein said latch member biasing means is adapted to contact said first outwardly projecting surface with at least an upper surface of said second end of said blade when said end piece is in said closed position.

12. The skate guard according to claim 1 further comprising a latch member stop means.

13. The skate guard according to claim 11, wherein said latch member further comprises a second outwardly projecting surface, wherein said second outwardly projecting surface is located above said first outwardly projecting surface, and wherein said second outwardly projecting surface is upward facing when said end piece is in said closed position, and wherein said first and second outwardly projecting surfaces intersect at a distal end of said latch member.

14. The skate guard according to claim 13 wherein when inserting said second end of said blade into said end piece from a position above said skate guard with said end piece in said closed position, said second end of the skate blade first contacts said second outwardly projecting surface and forces said latch member rearward until said second end of the skate blade contacts said position where said first and second outwardly projecting surfaces intersect, and subsequently upon further insertion, said second end of said blade is secured by said first outwardly projecting surface.

15. The skate guard according to claim 14 wherein said end piece pivots relative to said closed position while inserting said blade.

16. The skate guard according to claim 1 wherein further upward rotation of said end piece beyond said closed position is prevented by the contact of a portion of said end piece and a portion of said adapter piece.

17. The skate guard according to claim 1 wherein said end piece and said adapter piece each comprise a mating surface, wherein said mating surfaces are adapted to contact when said end piece is in said closed position.

18. The skate guard according to claim 1 wherein said adapter piece comprises a longitudinal channel adapted to receive said blade partially therein.

19. The skate guard according to claim 1 wherein said end piece comprises a longitudinal channel adapted to receive said blade partially therein.

20. The skate guard according to claim 1 wherein the skate blade may be removed from the skate guard after pivoting said end piece from said closed position to an open position.

21. The skate guard according to claim 1 wherein said skate guard may be detached from said blade by a user without applying a longitudinal force to said skate guard relative to said blade.

22. The skate guard according to claim 1 wherein a bottom surface of said end piece comprises heel segments extending laterally from said end piece, said heel segments adapted to contact a floor or other surface when a user is walking with said skate guard installed.

23. The skate guard according to claim 22 wherein a distance between distal ends of said heel segments is greater than an average width of said skate guard.

24. The skate guard according to claim 22 wherein said end piece comprises an upwardly curved rear surface, and wherein said heel segments comprise at least a portion of said upwardly curved rear surface.

25. The skate guard according to claim 1 wherein a bottom surface of said body piece comprises ball segments extending laterally from said body piece near said first end of said body piece, said ball segments adapted to contact a floor or other surface when a user is walking with said skate guard installed.

26. The skate guard according to claim 25 wherein a distance between distal ends of said ball segments is greater than an average width of said skate guard.

27. The skate guard according to claim 25 wherein said body piece comprises an upwardly curved front surface, and wherein said ball segments comprise at least a portion of said upwardly curved front surface.

28. A skate guard comprising an elongated body piece comprising a longitudinal channel adapted to receive a first portion of a skate blade, said body piece further comprising a socket for receiving a first end of said skate blade at a first end of said body piece;

an end piece pivotally attached to a second end of said body piece, said end piece adapted receive a second portion of the skate blade when said end piece is pivoted from an open position into a closed position; and means for detachably securing said end piece in said closed position; and a latch member movable relative to said end piece, and a latch member biasing means, wherein said latch member biasing means is adapted to contact a portion of said latch member with said second end of said blade when said end piece is in said closed position;

wherein when said skate blade is secured by said skate guard, said end piece is pivotally attached to said body piece at a location below a bottom surface of the skate blade.

29. The skate guard according to claim 1 wherein said skate guard may be detached from the skate blade by a user without applying a longitudinal force to said skate guard relative to the skate blade.

* * * * *